US009302510B2

(12) United States Patent
Akatsu et al.

(10) Patent No.: US 9,302,510 B2
(45) Date of Patent: Apr. 5, 2016

(54) MEDIUM LOADING DEVICE AND RECORDING APPARATUS

(71) Applicant: SEIKO EPSON CORPORATION, Tokyo (JP)

(72) Inventors: Shoji Akatsu, Shiojiri (JP); Akira Mashima, Azumino (JP); Tomoya Murotani, Matsumoto (JP); Yoshitaka Shimada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/391,364

(22) PCT Filed: Mar. 19, 2013

(86) PCT No.: PCT/JP2013/001851

§ 371 (c)(1),
(2) Date: Oct. 8, 2014

(87) PCT Pub. No.: WO2013/153747

PCT Pub. Date: Oct. 17, 2013

(65) Prior Publication Data

US 2015/0103126 A1 Apr. 16, 2015

(30) Foreign Application Priority Data

Apr. 11, 2012 (JP) ..... 2012-090275

(51) Int. Cl.
*B41J 2/01* (2006.01)
*B41J 11/04* (2006.01)
*B65H 16/06* (2006.01)

(52) U.S. Cl.
CPC ..... *B41J 11/04* (2013.01); *B65H 16/06* (2013.01); *B65H 2301/41346* (2013.01); *B65H 2402/52211* (2013.01); *B65H 2403/511* (2013.01); *B65H 2801/36* (2013.01)

(58) Field of Classification Search
CPC ..... B65H 19/10; B65H 16/10; B65H 18/08; B41J 15/04; B41J 15/15; B41J 15/16; B41J 11/007
USPC ..... 347/104; 242/390.2
See application file for complete search history.

(56) References Cited

U.S. PATENT DOCUMENTS

| | | | | |
|---|---|---|---|---|
| 4,200,245 | A * | 4/1980 | Bugnone | 242/533.6 |
| 2008/0277851 | A1 | 11/2008 | Genta | |
| 2009/0212152 | A1 | 8/2009 | Ozaki et al. | |
| 2013/0233961 | A1 * | 9/2013 | Niioka et al. | 242/563.1 |

FOREIGN PATENT DOCUMENTS

| | | | |
|---|---|---|---|
| DE | 10 2006 005785 | A1 | 8/2007 |
| EP | 1852265 | A1 | 11/2007 |
| JP | 11-79492 | A | 3/1999 |
| JP | 2001-130792 | A | 5/2001 |
| JP | 2002-068537 | A | 8/2002 |
| JP | 2006-289696 | A | 10/2006 |
| JP | 2007-261086 | A | 10/2007 |
| JP | 2009-023171 | A | 5/2009 |
| JP | 2009-226920 | A | 8/2009 |
| JP | 2009-202410 | A | 10/2009 |

* cited by examiner

*Primary Examiner* — Julian Huffman
*Assistant Examiner* — Sharon A Polk
(74) *Attorney, Agent, or Firm* — Workman Nydegger

(57) ABSTRACT

A medium loading device includes a support unit having shaft members mounted on both end portions of a roll paper and flange member and a loading portion where the roll paper with the support unit is loaded. The loading portion includes a rotary driving portion as a driving source to rotate the roll paper, a rotation shaft to transmit torque of the rotary driving portion to the roll paper via the shaft member, and an operation portion that moves the rotation shaft between a transmission position to transmit the torque to the roll paper and a non-transmission position not to transmit the torque to the roll paper. In an axial direction of the roll paper when the roll paper is loaded into the loading portion, the operation portion is disposed between the position where the shaft member is located when the roll paper is loaded and the rotary driving portion.

12 Claims, 18 Drawing Sheets

MEDIUM LOADING DEVICE AND RECORDING APPARATUS

TECHNICAL FIELD

The present invention relates to a recording apparatus such as an ink jet type printer and a medium loading device provided in the recording apparatus.

BACKGROUND ART

In general, as one type of a recording apparatus, an ink jet type printer has been widely known. These kinds of printers perform printing by supplying ink to a recording head and ejecting the supplied ink onto a recording medium from nozzles of the recording head. In these kinds of printers, a printer using a roll paper as a recording medium has been proposed (PTL 1, for example).

In the printer according to PTL 1, a roll paper holder includes a fixed flange bearer, a movable flange bearer and a guide rail installed between both flange bearers. When a user carries out the work of setting a roll paper to the roll paper holder, the roll paper of which both ends are fitted into flanges is placed on the guide rail along the guide rail.

Subsequently, when the movable flange bearer is slidably moved to the fixed flange bearer side along the guide rail, each of the flanges in both ends of the roll paper is fitted into the movable flange bearer and the fixed flange bearer, and is supported. Thereby, the work of setting the roll paper is completed.

CITATION LIST

Patent Literature

PTL 1: JP-A-2007-261086

SUMMARY OF INVENTION

Technical Problem

However, in the printer according to PTL 1, if the movable flange bearer is provided with a motor (rotary driving portion) to rotate a roll paper, the weight of the movable flange bearer is increased. Therefore, it is difficult to slidably move the movable flange bearer along the guide rail. As a result, there is a problem in that work efficiency of the work of setting a roll paper is deteriorated.

Furthermore, this problem is not limited to the ink jet type printer described above, and the same kind of problem can occur in recording apparatuses using a roll paper.

The invention is made focusing on such a problem of the related art. An object of the invention is to provide a medium loading device and a recording apparatus capable of improving work efficiency for enabling torque of a rotary driving portion to be transmitted to a roll medium loaded into a loading portion.

Solution to Problem

In order to achieve the object described above, a medium loading device of the invention includes: a support unit that has medium holding portions which are mounted on both end portions of a roll medium formed by winding a lengthy medium into a roll shape so as to be integrally rotatable with the roll medium, and a medium support portion which rotatably supports the medium holding portion; and a loading portion in which the roll medium mounted with the support unit is loaded, in which the loading portion includes: a rotary driving portion as a driving source to rotate the roll medium; a torque transmission portion to transmit a torque of the rotary driving portion to the roll medium via the medium holding portion; and an operation portion that moves the torque transmission portion between a transmission position to transmit the torque to the roll medium via the medium holding portion and a non-transmission position not to transmit the torque to the roll medium via the medium holding portion, and in which, in an axial direction of the roll medium when the roll medium is loaded into the loading portion, the operation portion is disposed between the position where the medium holding portion is located when the roll medium is loaded into the loading portion and the rotary driving portion.

According to the invention, when the roll medium is loaded into the loading portion, the operation portion is disposed at the position near the medium holding portion. Therefore, it is possible to rapidly perform an operation to move the torque transmission portion to the transmission position where the torque of the rotary driving portion is transmitted to the roll medium loaded into the loading portion via the medium holding portion. Consequently, it is possible to improve work efficiency for enabling the torque of the rotary driving portion to be transmitted to the roll medium loaded into the loading portion.

In the medium loading device of the invention, an access space to access the medium holding portion in the axial direction of the roll medium is formed between the position where the medium holding portion is located when the roll medium is loaded and the rotary driving portion. Also, the operation portion includes: an operation lever to perform the operation; and a shield portion that is moved between a shielding position to shield the access space and a non-shielding position not to shield the access space corresponding to the operation of the operation lever, in which, when the shield portion is moved to the shielding position, the torque transmission portion is moved to the transmission position, and when the shield portion is moved to the non-shielding position, the torque transmission portion is moved to the non-transmission position.

According to the invention, when the torque transmission portion transmits the torque of the rotary driving portion to the roll medium via the medium holding portion, the access space is shielded by the shield portion. Therefore, it is possible to regulate the access of a user to the medium holding portion when rotating. On the other hand, when the torque transmission portion does not transmit the torque of the rotary driving portion to the roll medium via the medium holding portion, the access space is not shielded by the shield portion. Therefore, it is possible to allow the access of a user to the medium holding portion when stopping.

In the medium loading device of the invention, the operation portion is configured such that, when the operation lever is moved to a lower side, the shield portion is moved to the shielding position, and when the operation lever is moved to an upper side, the shield portion is moved to the non-shielding position.

According to the invention, when the torque transmission portion transmits the torque to the roll medium via the medium holding portion, the shield portion is moved to the shielding position by moving the operation lever to the lower side. Therefore, it is possible for the operation lever not to hinder the medium holding portion when rotating.

The medium loading device of the invention further includes a cover member that is displaceable between a covering position where the roll medium loaded into the loading portion is covered and a non-covering position where the roll medium loaded into the loading portion is not covered, in which, when the cover member is positioned at the covering position, the operation portion is accommodated in the cover member.

According to the invention, since the operation portion is accommodated in the cover member by displacing the cover member to the covering position, it is possible to suppress the erroneous contact of a user to the operation portion.

A recording apparatus according to the invention includes the medium loading device configured as above and a recording portion to perform a recording process onto the roll medium fed from the medium loading device.

Advantageous Effects of Invention

According to the invention, it is possible to achieve the same action effect with the case of the medium loading device described above.

DESCRIPTION OF EMBODIMENTS

Hereinafter, an embodiment embodying a recording apparatus of the invention in an ink jet type printer will be described with reference to drawings.

Figure 1:
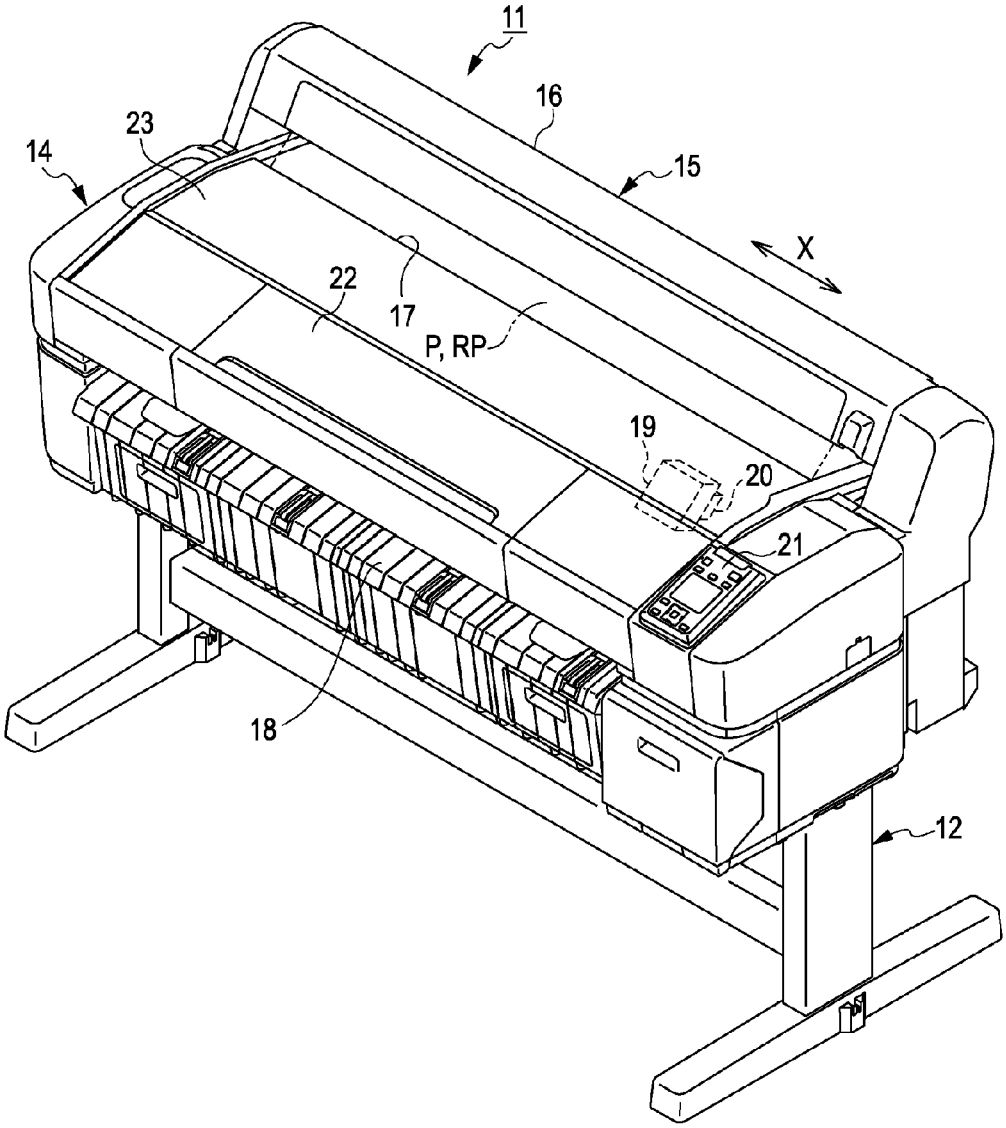
FIG. 1 is a perspective view of an ink jet type printer according to an embodiment.

As shown in FIG. 1, an ink jet type printer 11 as a recording apparatus is supported by a leg base 12. The ink jet type printer 11 includes a main body 14 having a substantially rectangular shape and a loading portion 15. The loading portion 15 is provided so as to obliquely protrude from a rear portion of the main body 14 to a rear upper side, and loads a roll paper RP which is formed by winding a paper P as a lengthy medium into a roll shape and used as a roll medium therein.

In an upper end portion of the loading portion 15, an opening and closing cover 16 as a cover member is provided so as to be freely opened and closed. In other words, the opening and closing cover 16 is provided so as to be pivotable (displaceable) between a covering position (position shown in FIG. 18) where the roll paper RP loaded into the loading portion 15 is covered and a non-covering position (position shown in FIG. 17) where the roll paper RP loaded into the loading portion 15 is not covered.

In a boundary position between the lower end portion of the loading portion 15 and the main body 14, a paper feeding port 17 to feed the paper P which is unwound and fed from the roll paper RP loaded into the loading portion 15 to the inside of the main body 14 is formed. In the main body 14, a transport mechanism (not shown) which transports, along the transport path thereof, the paper P fed from the paper feeding port 17 to a paper discharge port 18 formed on the front portion of the main body 14 is provided.

In the main body 14, a carriage 19 is provided at a position opposing to the transport path of the paper P so as to be reciprocatable in a width direction perpendicular to the transport direction of the paper P. In the carriage 19, a recording head 20 as a recording portion which performs printing as a recording process by reciprocating with the carriage 19 in a scanning direction X perpendicular to the transport direction of the paper P and ejecting ink from nozzles (not shown) onto the paper P transported along the transport path is supported against a position opposing to the transport path of the paper P.

The scanning direction X is a direction parallel to an axial direction (width direction of the roll paper RP) of the roll paper RP and a longitudinal direction of the main body 14. Furthermore, on, for example, an upper portion of a right end of the main body 14, an operation panel 21 for a user to perform various kinds of setting operations or an input operation of information is provided.

On the front side in an upper portion of the main body 14, a maintenance cover 22 to perform the maintenance inside the main body 14 is provided in a center portion in the scanning direction X so as to be freely opened and closed. On the other hand, a top plate 23 having a rectangular shape is provided on the half of an upper end portion of the main body 14 in the loading portion 15 side (rear side opposing to the front side).

Figure 2:
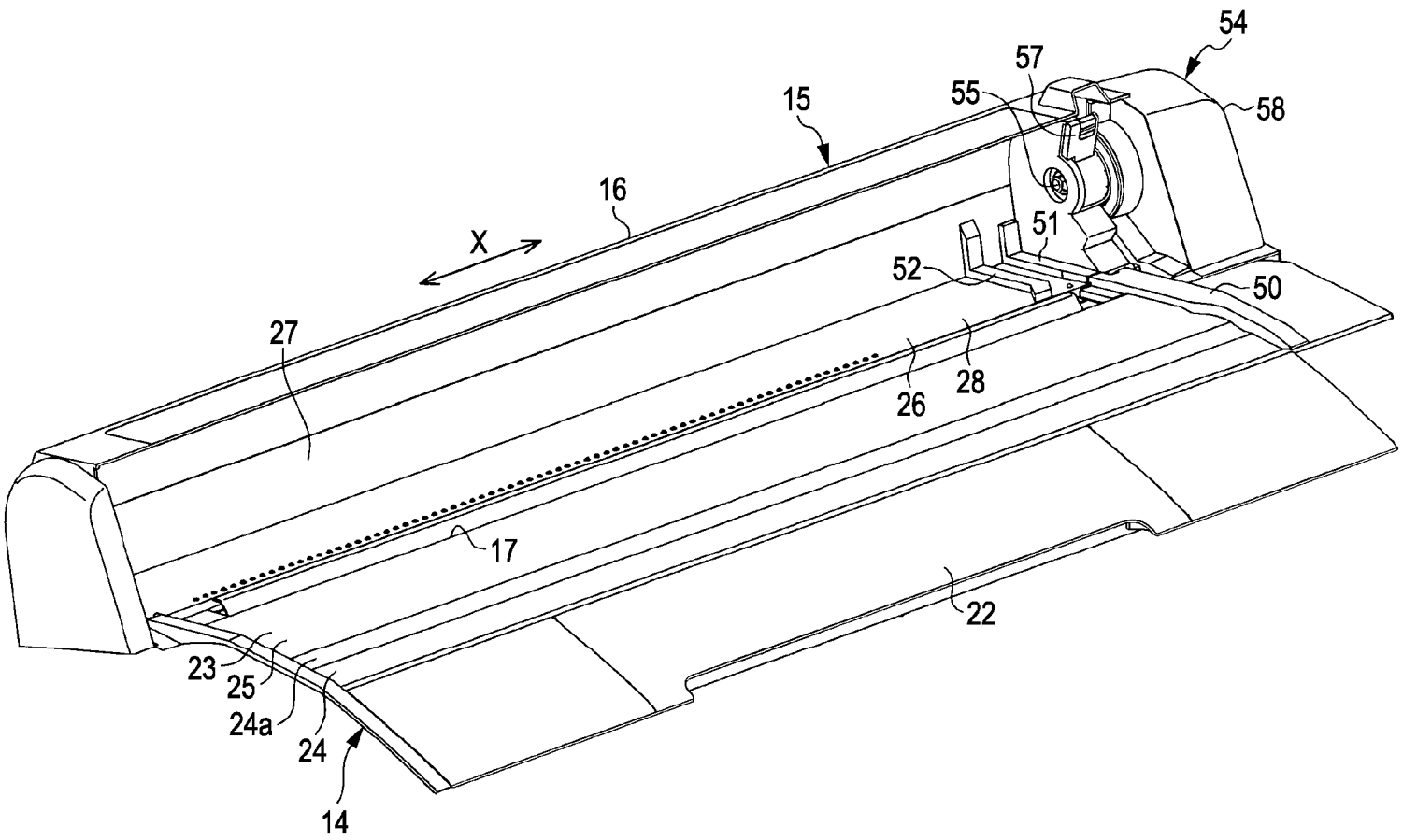
FIG. 2 is a perspective view of a main portion of the printer.

As shown in FIG. 2, the top plate 23 includes a horizontal temporal placing portion 24 to temporally place the roll paper RP (see FIG. 14) prior to loading it into the loading portion 15, and an inclined portion 25 inclined so as to descend from the temporal placing portion 24 toward the loading portion 15. In the temporal placing portion 24, a positioning recess portion **24*a* which is used to position the roll paper RP while suppressing the rolling movement at the time of temporally placing the roll paper RP (see FIG. 14**) is formed so as to extend in the scanning direction X.

On the lower end portion of the loading portion 15, a bottom plate 26 which has a rectangular shape and is parallel to the inclined portion 25 is formed. In this case, the paper feeding port 17 is positioned between the bottom plate 26 and the inclined portion 25. On an end portion on the opposite side to the paper feeding port 17 side in the bottom plate 26, a rear plate 27 having a rectangular shape is installed in a standing manner so as to be perpendicular to the bottom plate 26. Also, an area on the bottom plate 26 is a placing portion 28 where the roll paper RP is placed at the time of loading the roll paper RP (see FIG. 15) into the loading portion 15. Therefore, the placing portion 28 is positioned at a position lower than the temporal placing portion 24.

Figure 3:
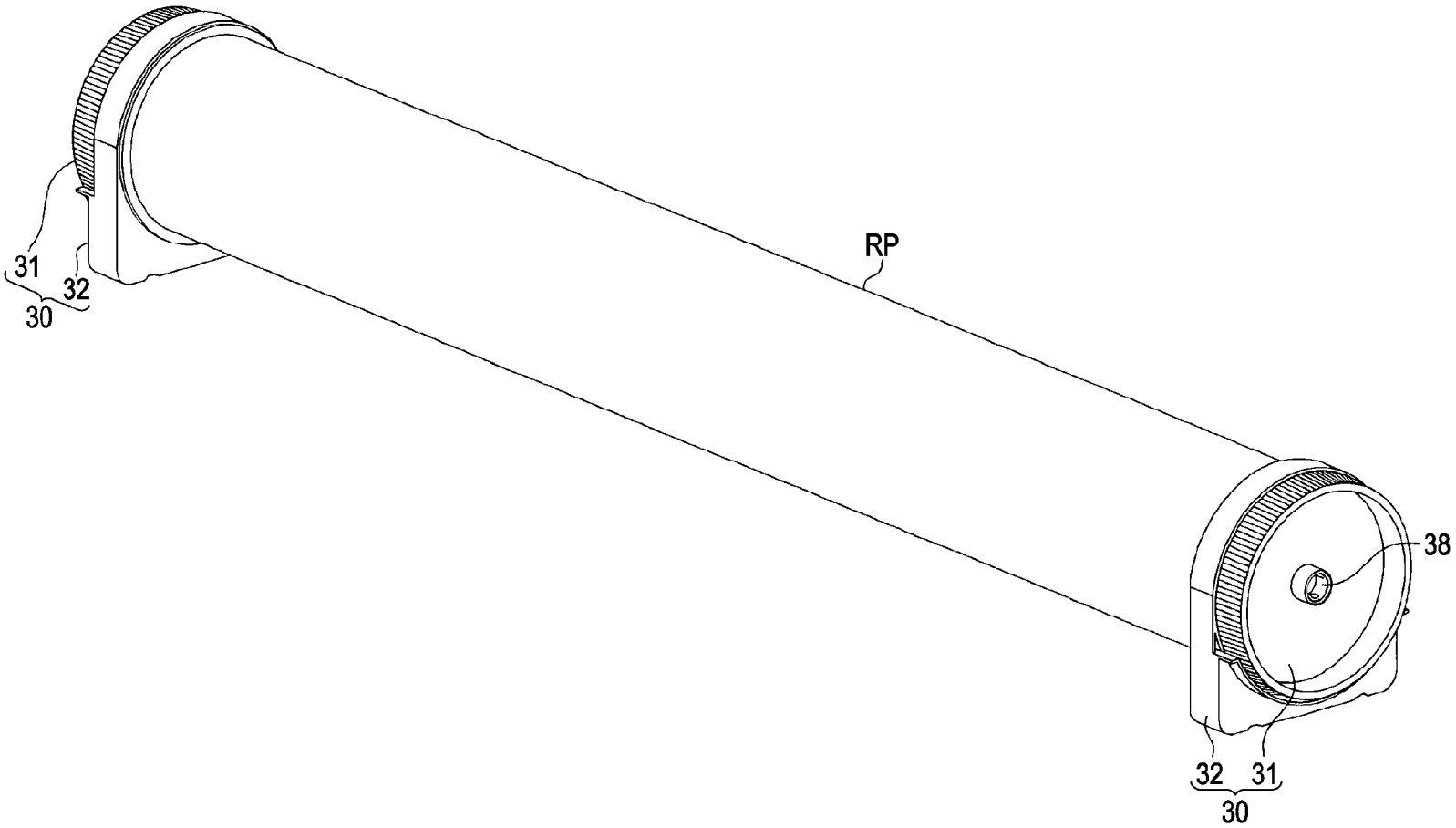
FIG. 3 is a perspective view of a roll paper mounted with a support unit.

As shown in FIGS. 2 and 3, when the roll paper RP is loaded into the loading portion 15, support units 30 to rotatably support the roll paper RP are mounted on the both end portions of the roll paper RP. In other words, the support unit 30 includes a shaft member 31 as a medium holding portion which holds the roll paper RP so as to be integrally rotatable with the roll paper RP, and a flange member 32 as a medium support portion which rotatably supports the shaft member 31.

Figure 4:
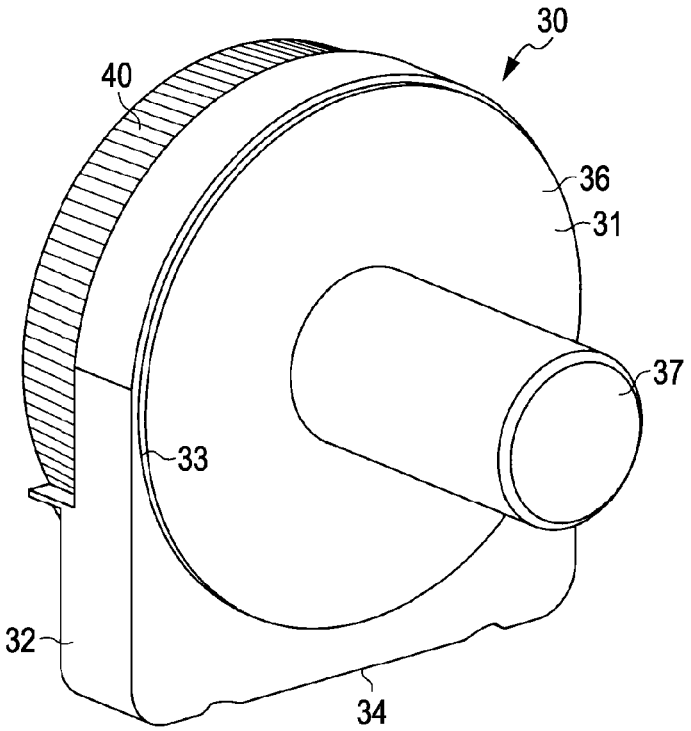
FIG. 4 is a perspective view of the support unit.
Figure 5:
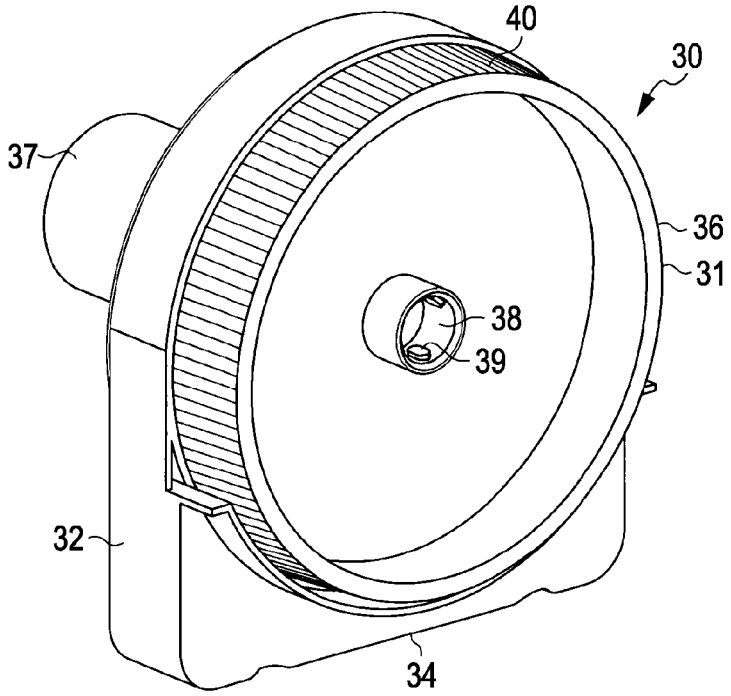
FIG. 5 is a perspective view of the support unit.

As shown in FIGS. 4 and 5, the upper half of the flange member 32 of the support unit 30 is formed in a semicircular shape and the lower half thereof is formed in a substantially rectangular shape. In other words, the overall shape of the flange member 32 is formed in a substantially D shape. A supporting hole 33 having a circular shape so as to be along an outer edge of the semicircular-shaped portion is formed on the flange member 32 in a penetrating manner. The lower surface of the flange member 32 is a flat surface 34 which is flat and has a substantially rectangular shape.

The shaft member 31 includes a rotating portion 36 having a substantially circular-plate shape, a shaft portion 37 having a cylindrical shape which protrudes on the center portion of a side surface on one side of the rotating portion 36 and is fitted into a center hole H (see FIG. 14) or the roll paper RP, and a shaft hole 38 having a circular shape which is formed on a center portion of a side surface (surface on the opposite side to a shaft portion 37 side) on the other side of the rotating portion 36. A plurality of engaging pieces 39 is formed on an inner circumferential surface of the shaft hole 38 at the same interval in a circumferential direction.

An outer diameter of the rotating portion 36 is designed so as to be slightly longer than an outer diameter of the roll paper RP of a maximum diameter. Half of the rotating portion 36 on the shaft portion 37 side is rotatably inserted in the supporting hole 33 of the flange member 32, and half of the rotating portion 36 on the opposite side to the shaft portion 37 is exposed. In the rotating portion 36, a plurality of ribs 40 functioning as slip stoppers when a user manually rotates the shaft member 31 are formed on a circumferential surface of the exposed part from the supporting hole 33 at the same interval in the circumferential direction.

Figure 6:
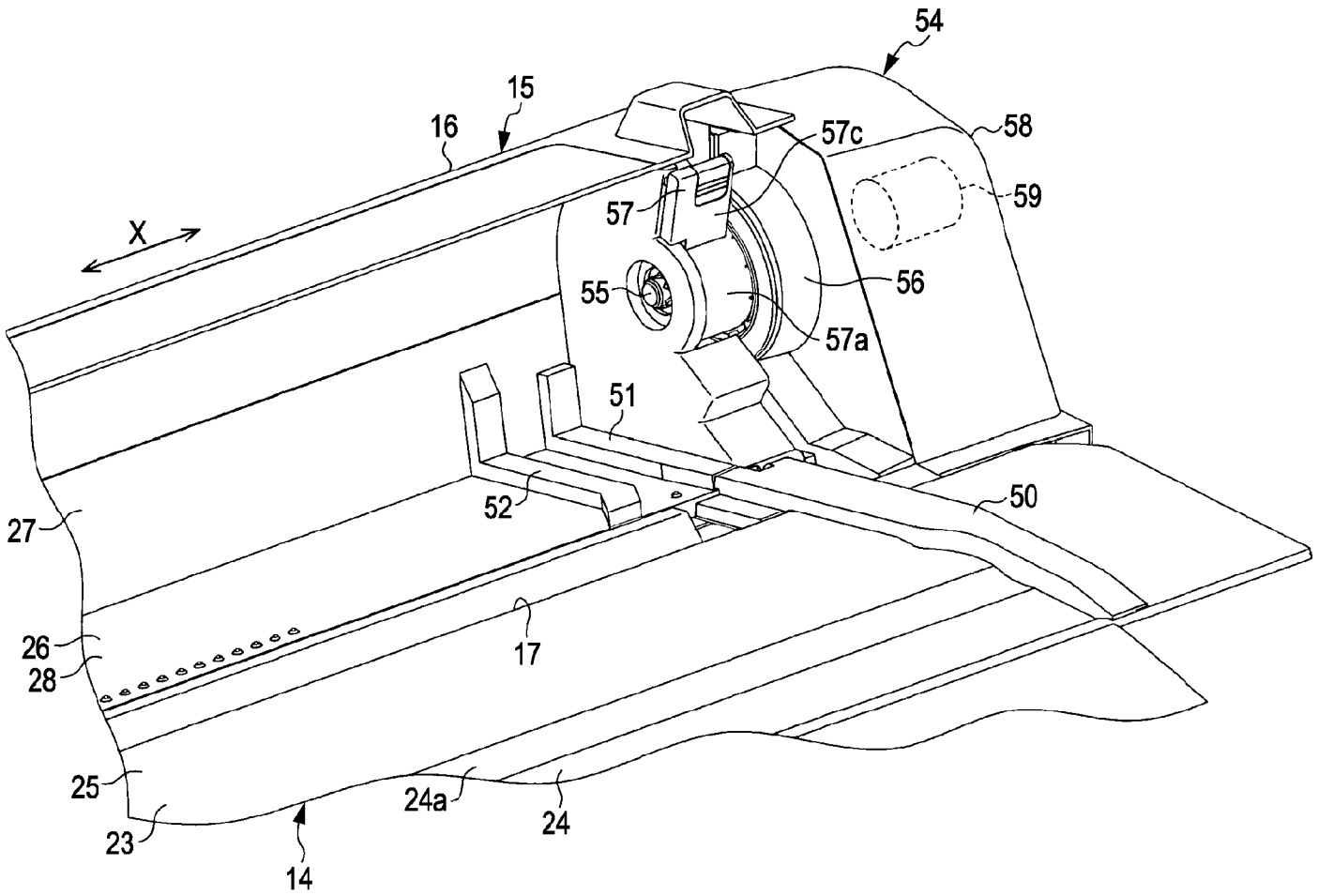
FIG. 6 is an enlarged perspective view of a main portion in FIG. 2.

As shown in FIG. 6, a first guide member 50 extending in a direction (front-rear direction in FIG. 6) perpendicular to the scanning direction X is provided on one end portion (right end portion in FIG. 6) in the top plate 23 of the main body 14 in the scanning direction X. Furthermore, a second guide member 51 extending in a direction (front-rear direction in FIG. 6) perpendicular to the scanning direction X is provided on one end portion (right end portion in FIG. 6) in the bottom plate 26 of the loading portion 15 in the scanning direction X.

One end side (front end side in FIG. 6) of the second guide member 51 is in contact with the first guide member 50, and the other end side (rear end side in FIG. 6) is perpendicularly bent upward and extends along the rear plate 27. In this case, the second guide member 51 is in contact with the first guide member 50 such that the surface of the first guide member 50 is approximately in the same plane as the surface of the second guide member 51 corresponding thereto. In addition, the tip end of the bent portion of the second guide member 51 extends to about half the height of the rear plate 27.

Still further, a third guide member 52 extending parallel to the second guide member 51 is provided on the bottom plate 26. As similar to the second guide member 51, an end portion of the third guide member 52 on the opposite side to the top plate 23 side is perpendicularly bent upward and extends along the rear plate 27. In this case, an interval between the second guide member 51 and the third guide member 52 is designed so as to be slightly wider than the thickness of the flange member 32 (see FIG. 4).

Therefore, when the roll paper RP (see FIG. 3) mounted with the support unit 30 is loaded into the loading portion 15, the flange member 32 of the support unit 30 is insertable between the second guide member 51 and the third guide member 52. Also, an end portion of the third guide member 52 on the top plate 23 side is bent at an angle of about 30 degrees on the opposite side to the second guide member 51 side in order to easily insert the flange member 32 between the second guide member 51 and the third guide member 52 from the top plate 23 side.

In the loading portion 15, a torque imparting unit 54 to impart torque to the roll paper RP via the shaft member 31 (see FIG. 3) at the time of placing the roll paper RP (see FIG. 3) mounted with the support unit 30 on the placing portion 28 is provided at a position (right end portion of the loading portion 15 in FIG. 6) opposing to the third guide member 52 interposing the second guide member 51 therebetween.

The torque imparting unit 54 includes a rotation shaft 55 as a torque transmission portion capable of moving along the scanning direction X retractably with respect to the placing portion 28, a shaft cover 56 covering the rotation shaft 55, an operation portion 57 to operate the rotation shaft 55 so as to be retracted with respect to the placing portion 28, and a rotary driving portion 59 to rotationally drive the rotation shaft 55 disposed in a case 58.

Figure 7:
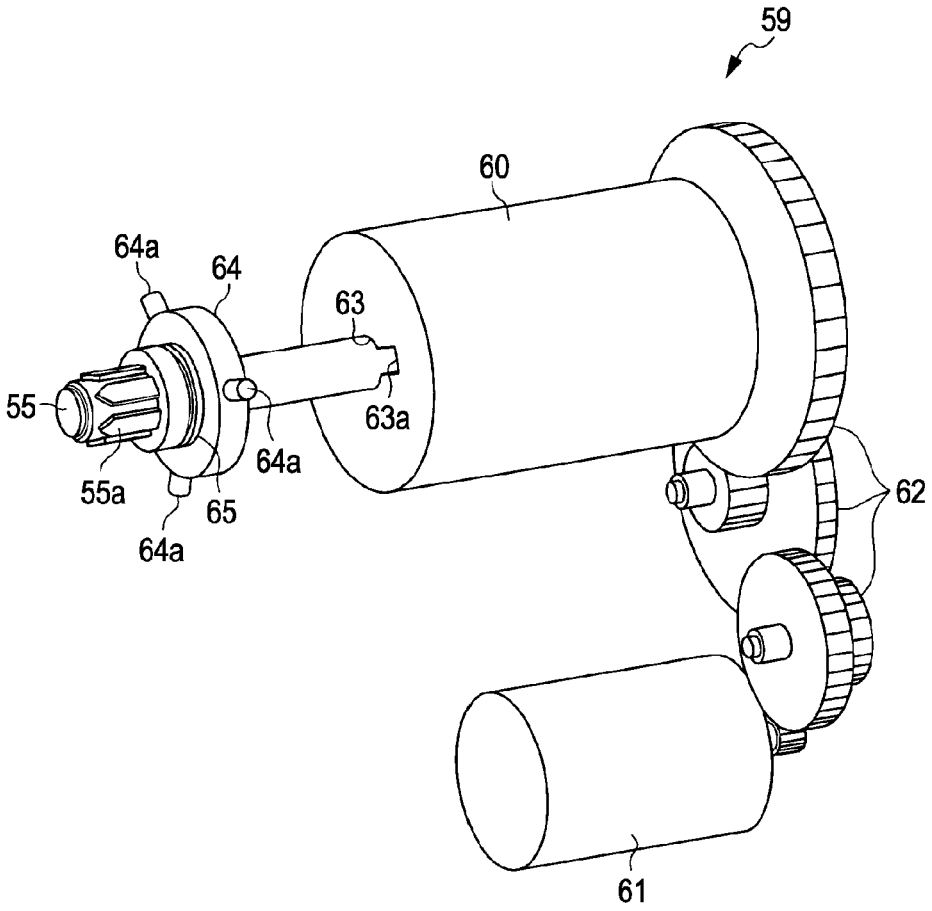
FIG. 7 is a perspective view showing a connection state between a rotary driving portion and a rotation shaft.

As shown in FIG. 7, the rotary driving portion 59 includes a support member 60 which has a cylindrical shape and supports the rotation shaft 55 slide-movably in an axial direction (scanning direction X) thereof, a motor 61 disposed in parallel with the support member 60, and a gear train 62 constituted of a plurality of gears which transmit rotation of the motor 61 to the support member 60.

In the support member 60, an insertion hole 63 in which a base end side of the rotation shaft 55 is slide-movably inserted is formed in a center portion of a surface on the opposite side to the gear train 62 side so as to extend in the axial direction of the support member 60.

On both sides of the support member 60 which face each other interposing the insertion hole 63, a pair of angular grooves **63*a* are formed so as to communicate with the insertion hole 63 and extend parallel to the insertion hole 63. On a base end portion of the rotation shaft 55, protrusions (not shown) which are slide-movably inserted in each of the angular grooves 63*a* at the time of inserting the base end portion of the rotation shaft 55 in the insertion hole 63** are formed.

Therefore, the rotation shaft 55 integrally rotates with the support member 60 by respectively engaging the protrusions (not shown) in a rotation direction centering on an axis thereof with the angular grooves **63*a*. In other words, if the motor 61 is driven and the rotation thereof is transmitted to the support member 60 via the gear train 62, the support member 60 integrally rotates with the rotation shaft 55**.

On a circumferential surface of a tip end portion of the rotation shaft 55, a plurality of engagement ribs **55*a*** are formed at the same interval in the circumferential direction.

The tip end portion of the rotation shaft 55 is insertable in the shaft hole 38 (see FIG. 5) of the shaft member 31 of the support unit 30. Also, when the tip end portion of the rotation shaft 55 is inserted in the shaft hole 38, the engagement ribs 55*a* are respectively engaged with the engaging pieces 39 (see FIG. 5) in the circumferential direction.

Therefore, if the rotation shaft 55 is rotationally driven in a state where the tip end portion of the rotation shaft 55 is inserted in the shaft hole 38 (see FIG. 5) of the shaft member 31, the engagement ribs 55*a* are respectively engaged with the engaging pieces 39 (see FIG. 5) in the rotation direction. Thereby, the torque is transmitted from the rotation shaft 55 to the shaft member 31. In the rotation shaft 55, a ring member 64 having a cylindrical shape is rotatably provided at a position near the base end rather than the tip end portion.

In the rotation shaft 55, E-rings 65 are respectively provided on both sides of the ring members 64 in the axial direction in order to regulate the movement of the ring member 64 in the axial direction. On a circumferential surface of the ring member 64, three convex portions 64*a* protruding in a radial direction are provided at the same interval in the circumferential direction.

Figure 8:
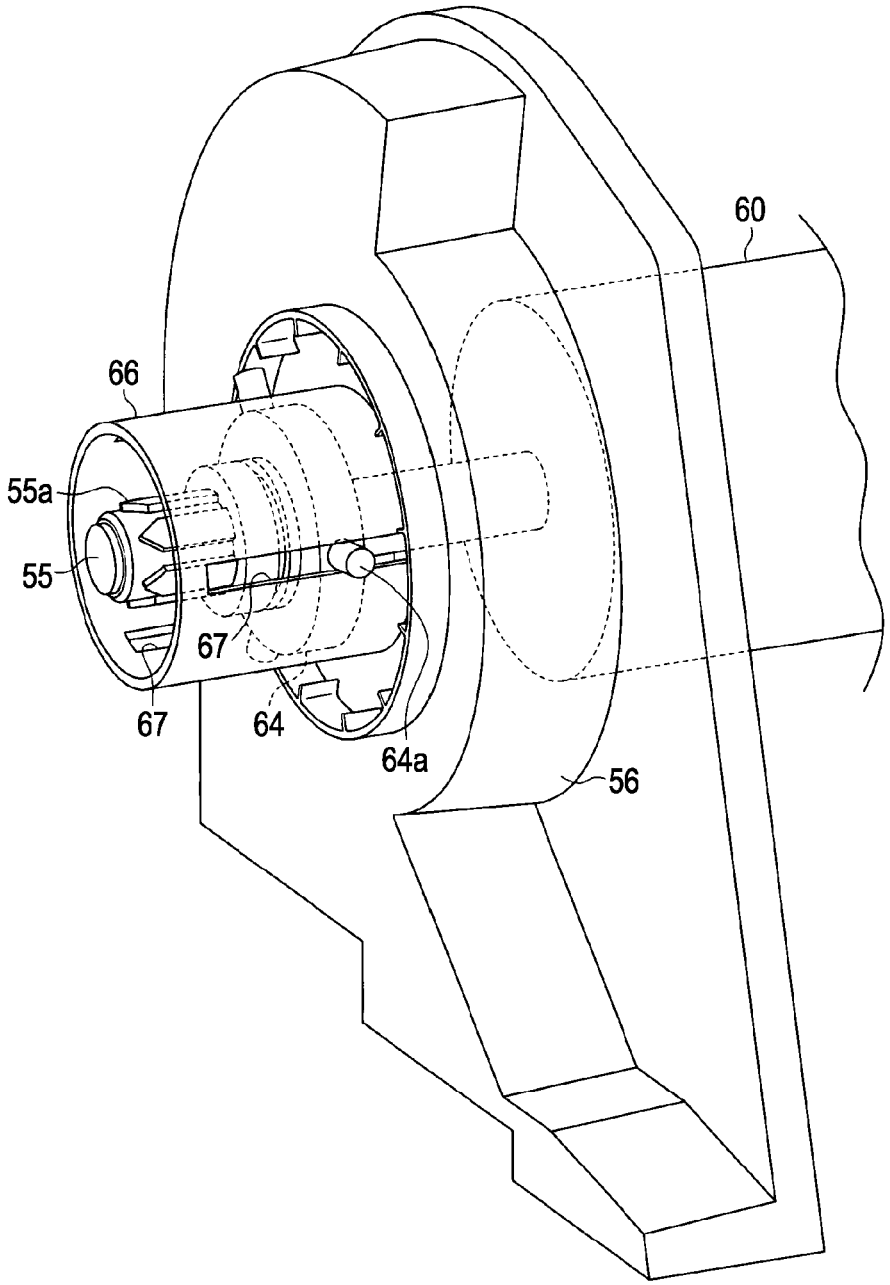
FIG. 8 is an enlarged perspective view showing a state where a shaft cover covers the rotation shaft.

As shown in FIG. 8, an accommodation portion 66 which has a cylindrical shape and accommodates the rotation shaft 55 therein is formed on a center portion of the shaft cover 56. On a peripheral wall of the accommodation portion 66, three through holes 67 which have a rectangular shape and extend in the axial direction are formed at the same interval in the circumferential direction. In addition, each of convex portions 64*a* of the ring member 64 is slide-movably inserted in each of the through holes 67.

Figure 9:
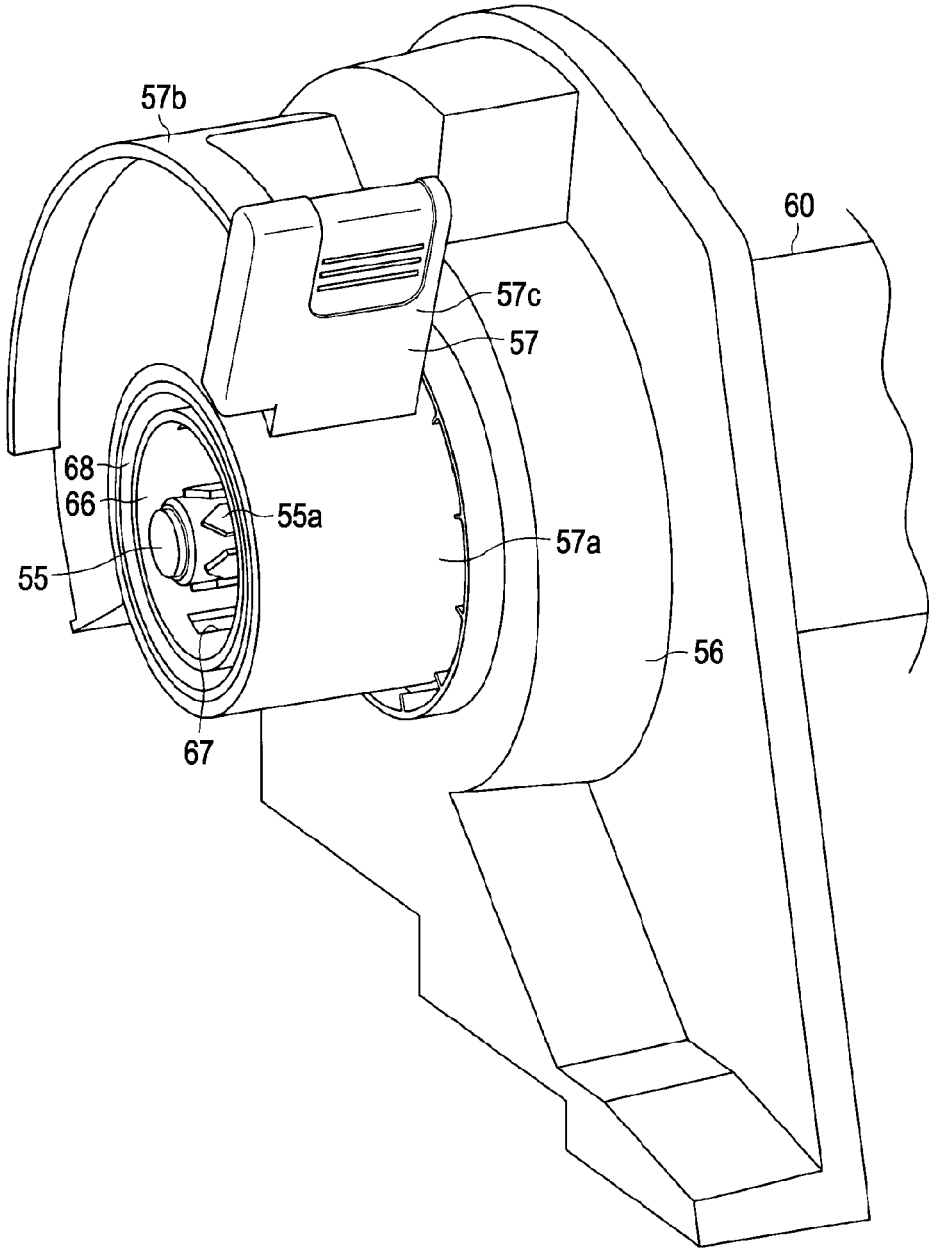
FIG. 9 is a perspective view showing a state where an operation portion is installed on the shaft cover in FIG. 8.

As shown in FIG. 9, the operation portion 57 includes a rotation shaft portion 57*a* having a cylindrical shape, a shield portion 57*b* which has a substantially semicircular-ring shape and is formed on a circumferential surface of the rotation shaft portion 57*a*, and a operation lever 57*c* which has a substantially rectangular-plate shape and is formed on the circumferential surface of the rotation shaft portion 57*a* so as to be adjacent to the shield portion 57*b*. In addition, the operation portion 57 is installed rotatably with respect to the shaft cover 56 such that the accommodation portion 66 is accommodated in the rotation shaft portion 57*a*.

Figure 10:
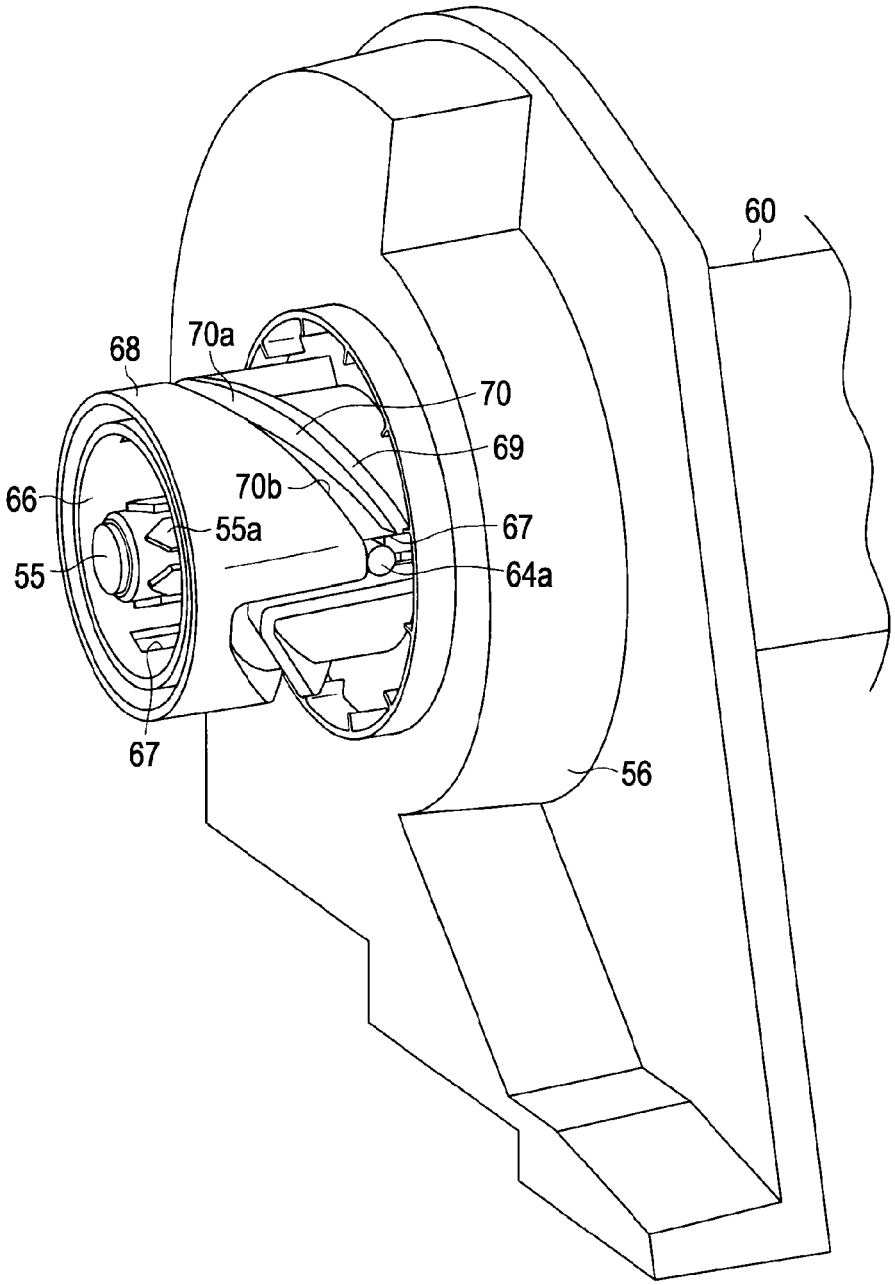
FIG. 10 is a perspective view showing a cam groove formed of a cam groove forming member and a cam groove forming wall.

As shown in FIGS. 9 and 10, on an inner circumferential surface of the rotation shaft portion 57*a*, a cam groove forming member 68 having a substantially cylindrical shape is installed so as to be integrally rotatable with the rotation shaft portion 57*a*. The internal diameter of the cam groove forming member 68 is greater than the external diameter of the accommodation portion 66, and the external diameter thereof is smaller than the internal diameter of the rotation shaft portion 57*a*. In addition, on the inner circumferential surface of the rotation shaft portion 57*a*, a cam groove forming wall 69 is provided so as to face the cam groove forming member 68 in the axial direction.

In this case, upon comparison with the position of the cam groove forming wall 69, the position of the cam groove forming member 68 is closer to the tip end side of the accommodation portion 66. In addition, by the cam groove forming member 68 and the cam groove forming wall 69, three cam grooves 70 are formed at the same interval in the circumferential direction of the rotation shaft portion 57*a*. In the cam groove 70, a surface on the cam groove forming wall 69 side is a first cam face 70*a* and a surface on the cam groove forming member 68 side is a second cam face 70*b*.

In each of the cam grooves 70, a tip end portion of each of the convex portions 64*a* of the ring member 64 is slidably inserted. From a position corresponding to a base end portion of the accommodation portion 66 to a position corresponding to a tip end portion of the accommodation portion 66, each of the cam grooves 70 extends obliquely with respect to the circumferential direction of the accommodation portion 66 so as to be along a circumferential surface of the accommodation portion 66.

As shown in FIGS. 6 and 10, in a state where the operation lever 57*c* of the operation portion 57 is positioned higher than the rotation shaft 55, the tip end portion of the rotation shaft 55 is accommodated in the accommodation portion 66, and also each of the convex portions 64*a* of the ring member 64 is positioned at an end portion on the rotary driving portion 59 side in each of the through holes 67 of the accommodation portion 66.

In this case, when the roll paper RP (see FIG. 3) mounted with the support unit 30 is placed at the placing portion 28, a position of the rotation shaft 55 is designated as a non-transmission position (position shown in FIGS. 6 and 10) where the torque of the rotary driving portion 59 is not transmitted to the roll paper RP via the shaft member 31 of the support unit 30.

Figure 11:
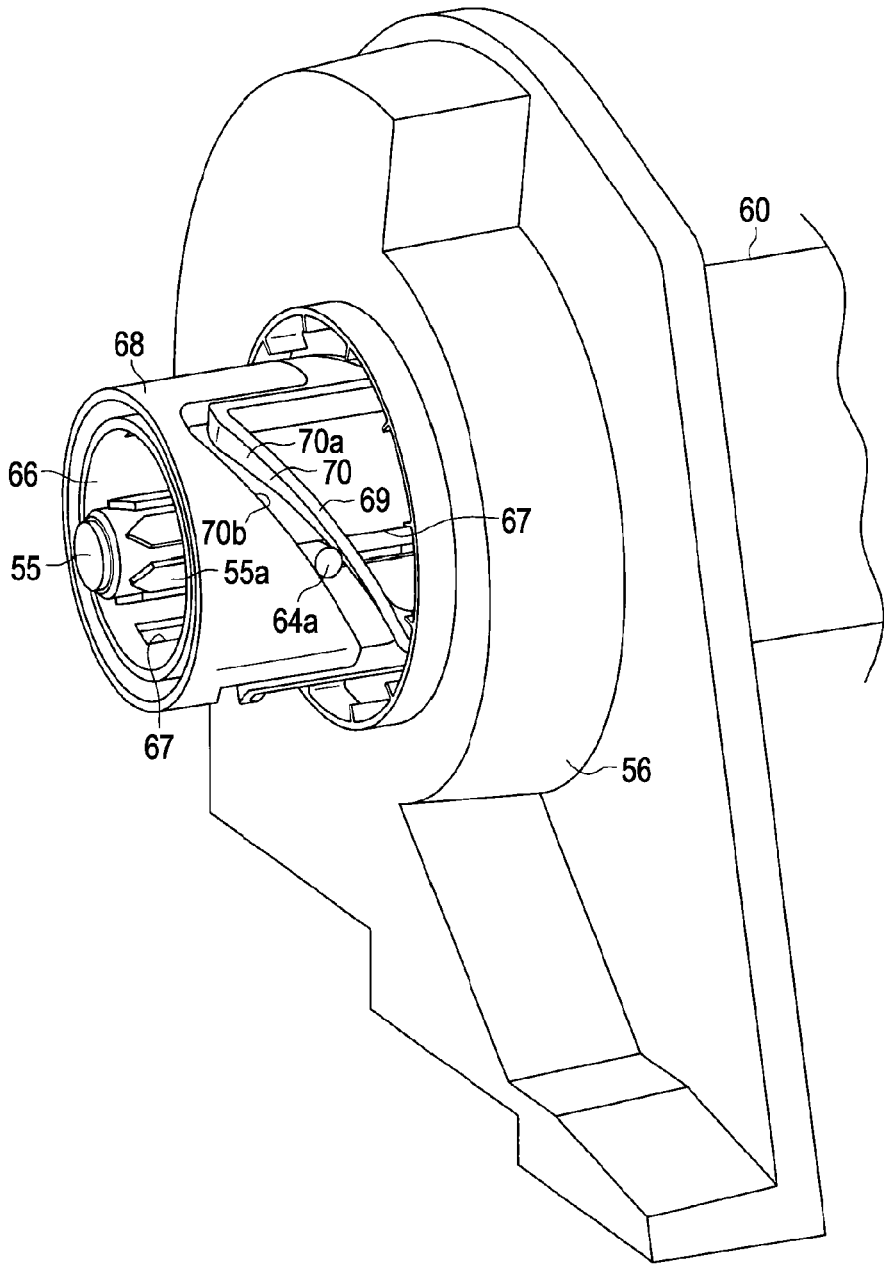
FIG. 11 is a perspective view showing a state when a convex portion of a ring member slidably moves in the cam groove.
Figure 13:
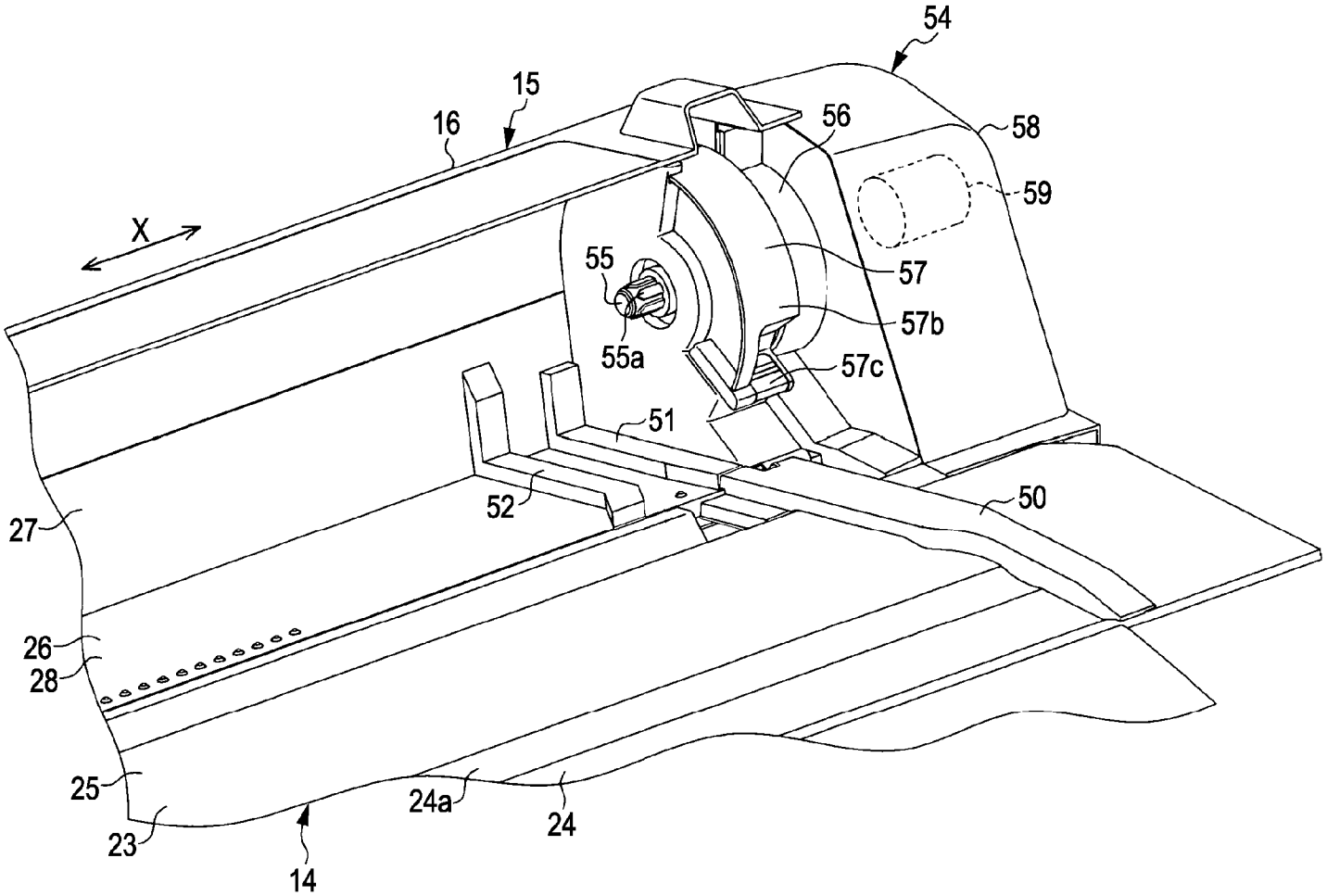
FIG. 13 is an enlarged perspective view of a main portion in a state where the operation lever is moved downward in FIG. 6.

Subsequently, in this state, when the operation lever 57*c* is operated such that the operation lever 57*c* of the operation portion 57 is moved (pivoted) toward a position where the operation lever 57*c* is positioned lower than the rotation shaft 55, as shown in FIG. 13, the rotation shaft 55 is moved while each of the convex portions 64*a* of the ring member 64 slides on each of the first cam faces 70*a*, as shown in FIG. 11. Thereby, as shown in FIGS. 11 and 13, each of the convex portions 64*a* of the ring member 64 is pressed to the placing portion 28 side by each of the first cam faces 70*a* and is slidably moved in each of the through holes 67 of the accommodation portion 66 toward an end portion thereof on the placing portion 28 side.

Figure 12:
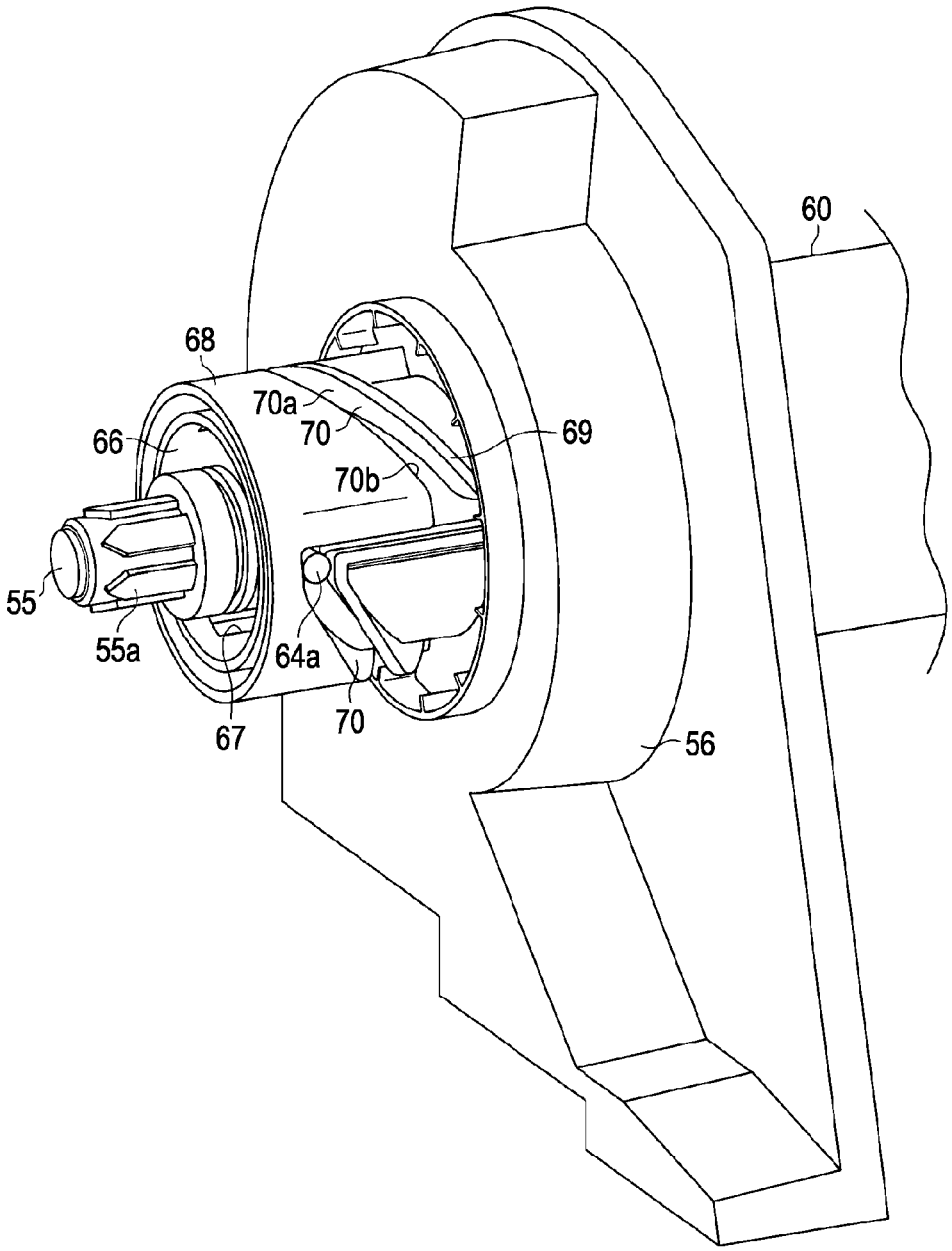
FIG. 12 is a perspective view showing a positional relationship between the cam groove and the convex portion of the ring member when the rotation shaft is located at a transmission position.

Corresponding to the slide-movement of each of the convex portions 64*a* of the ring member 64, the rotation shaft 55 is moved to the placing portion 28 side along the axial direction. Furthermore, as shown in FIGS. 12 and 13, in a state where the operation lever 57*c* of the operation portion 57 is moved to the position where the operation lever 57*c* is positioned lower than the rotation shaft 55, the tip end portion of the rotation shaft 55 protrudes outward the accommodation portion 66, and also each of the convex portions 64*a* of the ring member 64 is positioned at an end portion on the placing portion 28 side in each of the through holes 67 of the accommodation portion 66.

In this case, when the roll paper RP (see FIG. 3) mounted with the support unit 30 is placed at the placing portion 28, a position of the rotation shaft 55 is designated as a transmission position (position shown in FIGS. 12 and 13) where the torque of the rotary driving portion 59 is transmitted to the roll paper RP via the shaft member 31 of the support unit 30.

Furthermore, in the case of moving the rotation shaft 55 from the transmission position to the non-transmission position, when the operation lever 57*c* is operated such that the operation lever 57*c* of the operation portion 57 is moved (pivoted) to the position where the operation lever 57*c* is positioned higher than the rotation shaft 55, as shown in FIG. 6, the rotation shaft 55 is moved while each of the convex portions 64*a* of the ring member 64 slides on each of the second cam faces 70*b*, as shown in FIG. 11.

Thereby, as shown in FIGS. 6 and 11, each of the convex portions 64*a* of the ring member 64 is pressed to the rotary driving portion 59 side by each of the second cam faces 70*b* and is slidably moved in each of the through holes 67 of the accommodation portion 66 toward an end portion thereof on the rotary driving portion 59 side. Corresponding to the slide-movement of each of the convex portions 64*a* of the ring member 64, the rotation shaft 55 is moved to the rotary driving portion 59 side along the axial direction.

Furthermore, as shown in FIGS. 6 and 10, in a state where the operation lever 57*c* of the operation portion 57 is moved to the position where the operation lever 57*c* is positioned higher than the rotation shaft 55, the tip end portion of the rotation shaft 55 is accommodated in the accommodation portion 66, and also each of the convex portions 64*a* of the ring member 64 is positioned at an end portion on the rotary driving portion 59 side in each of the through holes 67 of the accommodation portion 66. In this manner, the rotation shaft 55 is moved from the transmission position to the non-transmission position.

Subsequently, the rotation shaft 55 is moved between the transmission position and the non-transmission position by operating the operation portion 57. Furthermore, in the embodiment, the loading portion 15, the support unit 30, the rotary driving portion 59, the rotation shaft 55, and the operation portion 57 constitute a medium loading device.

Next, the operation of the ink jet type printer 11 will be described.

Figure 14:
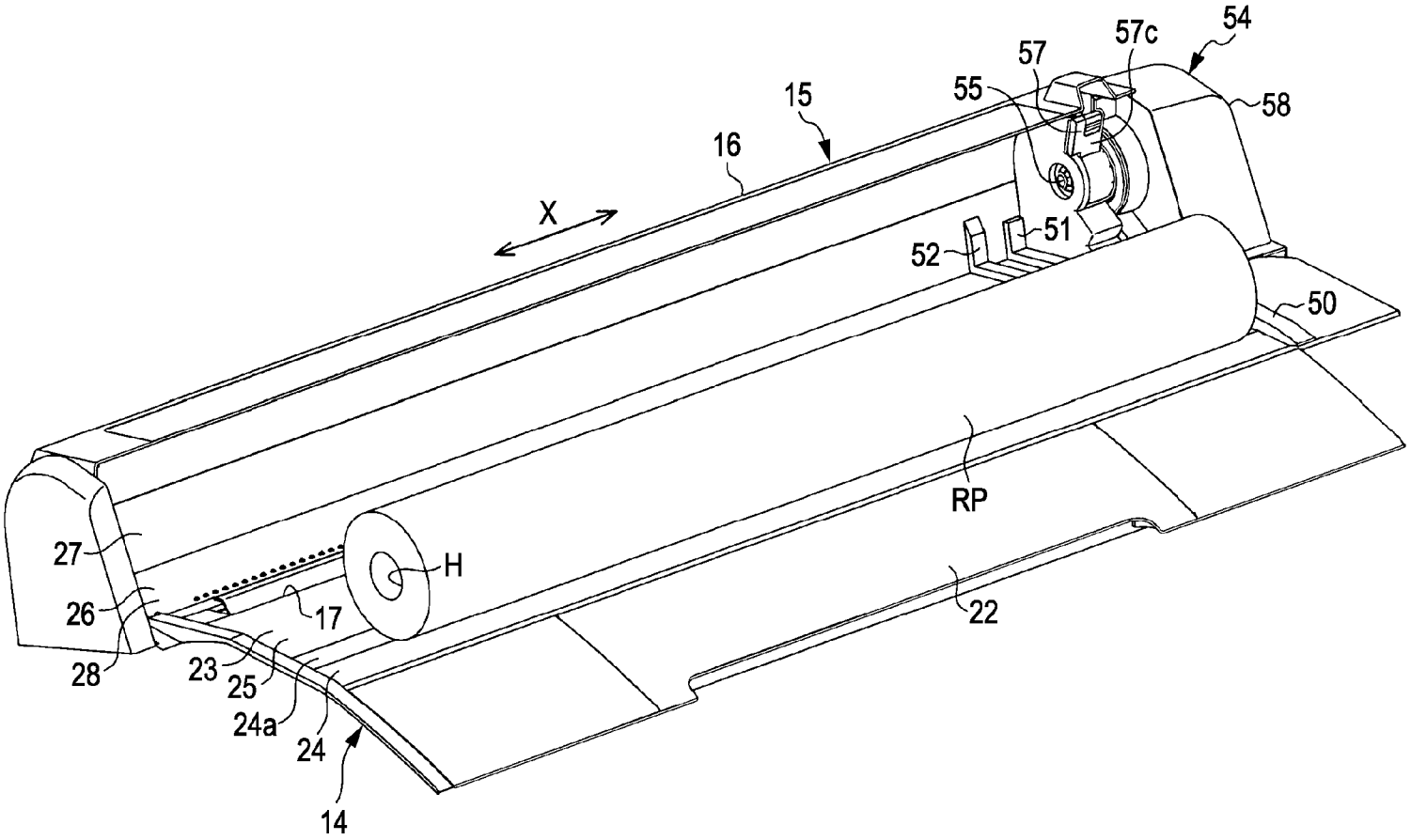
FIG. 14 is a perspective view showing a state where the roll paper is placed at a temporal placing portion in FIG. 2.

When performing printing onto the roll paper RP, first, the opening and closing cover 16 is opened (displaced to the non-covering position), and a user places the roll paper RP on the positioning recess portion 24*a* of the temporal placing portion 24 in a state where the rotation shaft 55 is placed at the non-transmission position by moving the operation lever 57*c* upward, as shown in FIG. 14. Thereupon, the roll paper RP is stable on the positioning recess portion 24*a*, whereby the rolling of the roll paper RP is suppressed.

Figure 15:
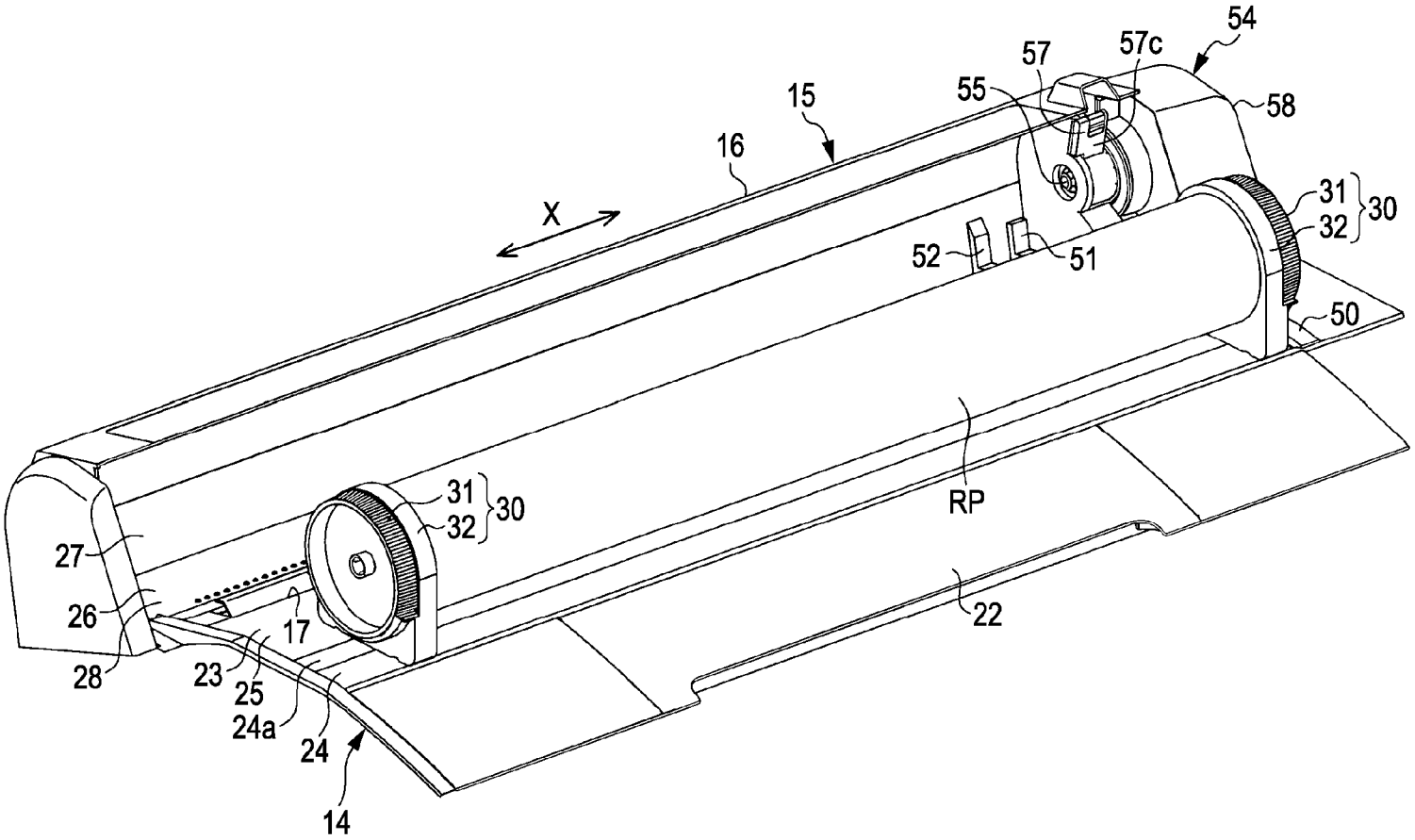
FIG. 15 is a perspective view showing a state where the support unit is mounted on the roll paper in FIG. 14.

Subsequently, as shown in FIG. 15, a user fits the shaft portion 37 (see FIG. 4) of the shaft member 31 of each of the support units 30 into the center hole H (see FIG. 14) of the roll paper RP from both sides thereof, whereby the support units 30 are respectively mounted on both end portions of the roll paper RP. Also, in a state where the support units 30 are respectively mounted on both end portions of the roll paper RP, the roll paper RP is supported by each of the support units 30 in a state where the roll paper RP is lifted from the temporal placing portion 24.

Next, a user presses the roll paper RP of which both end portions are mounted with the support units 30, namely each of the support units 30 supporting the roll paper RP, from the temporal placing portion 24 toward the placing portion 28.

Thereupon, each of the support units 30 supporting the roll paper RP is slidably moved on the top plate 23. In other words, each of the support units 30 supporting the roll paper RP is slidably moved downward on the inclined portion 25 toward the placing portion 28 while the roll paper RP does not rotate. In this case, the support unit 30 on the first guide member 50 side is introduced between the second guide member 51 and the third guide member 52 in the placing portion 28 while being guided by the first guide member 50.

Figure 16:
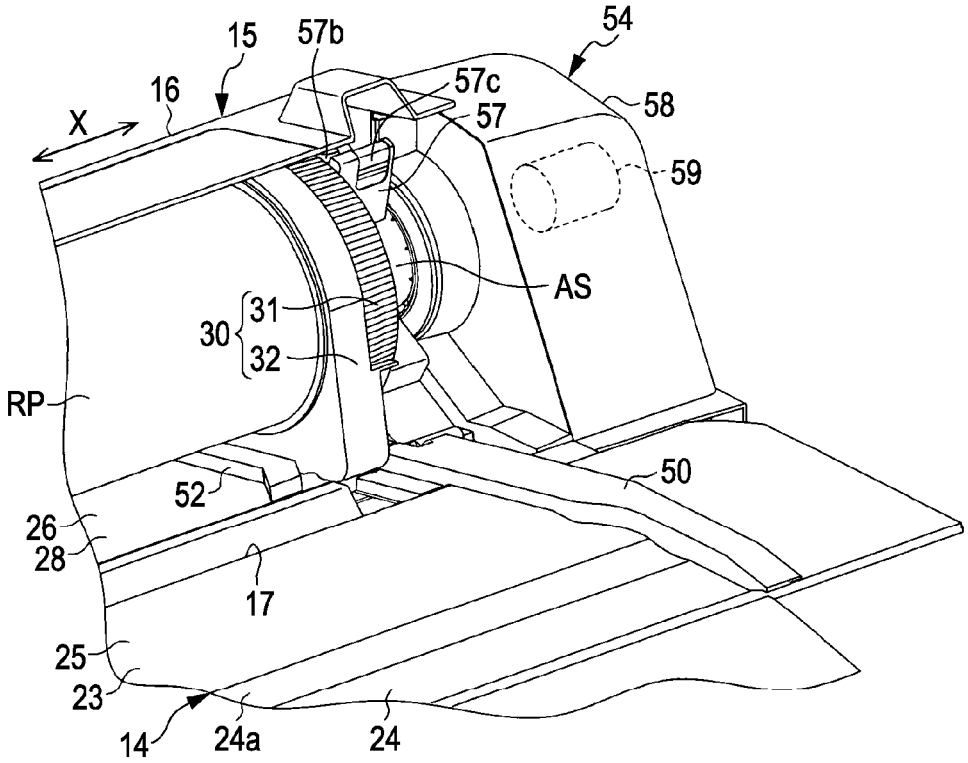
FIG. 16 is a perspective view showing a state where the roll paper mounted with the support unit is loaded into the loading portion in FIG. 6.

Subsequently, when a user presses each of the support units 30 to the placing portion 28 side, the roll paper RP is placed at the placing portion 28 in a state of being supported by each of the support units 30, as shown in FIG. 16.

In this case, the support unit 30 on the first guide member 50 side is inserted between the second guide member 51 and the third guide member 52 in the placing portion 28 while being guided by the second guide member 51 (see FIG. 15) and the third guide member 52. Therefore, the positioning of the support unit 30 on the first guide member 50 side in the scanning direction X is performed by the second guide member 51 and the third guide member 52, and consequently the positioning of the roll paper RP in the scanning direction X is performed.

Furthermore, in a state where the roll paper RP mounted with the support unit 30 is placed at the placing portion 28, the shaft hole 38 of the shaft member 31 in the support unit 30 on the first guide member 50 side faces the rotation shaft 55 in the scanning direction X. In other words, the rotational axis of the rotation shaft 55 coincides with the rotational axis of the roll paper RP (shaft member 31).

In this case, an access space AS for a user to access (touch) the shaft member 31 in the axial direction (scanning direction X) of the roll paper RP is formed between the shaft member 31 of the support unit 30 on the first guide member 50 side and the rotary driving portion 59 (case 58), namely on the rotary driving portion 59 (case 58) side in the shaft member 31 of the support unit 30 on the first guide member 50 side.

In addition, the operation portion 57 is disposed in the access space AS. In other words, in the axial direction of the roll paper RP when the roll paper RP is loaded into the loading portion 15, the operation portion 57 is disposed between a location of the shaft member 31 when the roll paper RP is loaded and the rotary driving portion 59.

Here, when the operation lever 57*c* of the operation portion 57 is positioned at the upper side, the shield portion 57*b* of the operation portion 57 is positioned at the non-shielding position (position shown in FIG. 16) where the access space AS is not shielded, as shown in FIG. 16. On the other hand, when the operation lever 57*c* of the operation portion 57 is positioned at the lower side, the shield portion 57*b* of the operation portion 57 is positioned at the shielding position (position shown in FIG. 17) where the access space AS is shielded, as shown in FIG. 17.

In other words, when the operation lever 57*c* is moved to the upper side, the shield portion 57*b* is moved to the non-shielding position where the access space AS is opened. However, when the operation lever 57*c* is moved to the lower side, the shield portion 57*b* is moved to the shielding position where the access space AS is closed. That is, corresponding to the upward or downward movement (pivot) of the operation lever 57*c*, the shield portion 57*b* is moved between the non-shielding position and the shielding position.

Therefore, when the shield portion 57*b* is moved to the shielding position, the rotation shaft 55 is moved to the transmission position, and when the shield portion 57*b* is moved to the non-shielding position, the rotation shaft 55 is moved to the non-transmission position, by operating the operation lever 57*c*.

Figure 17:
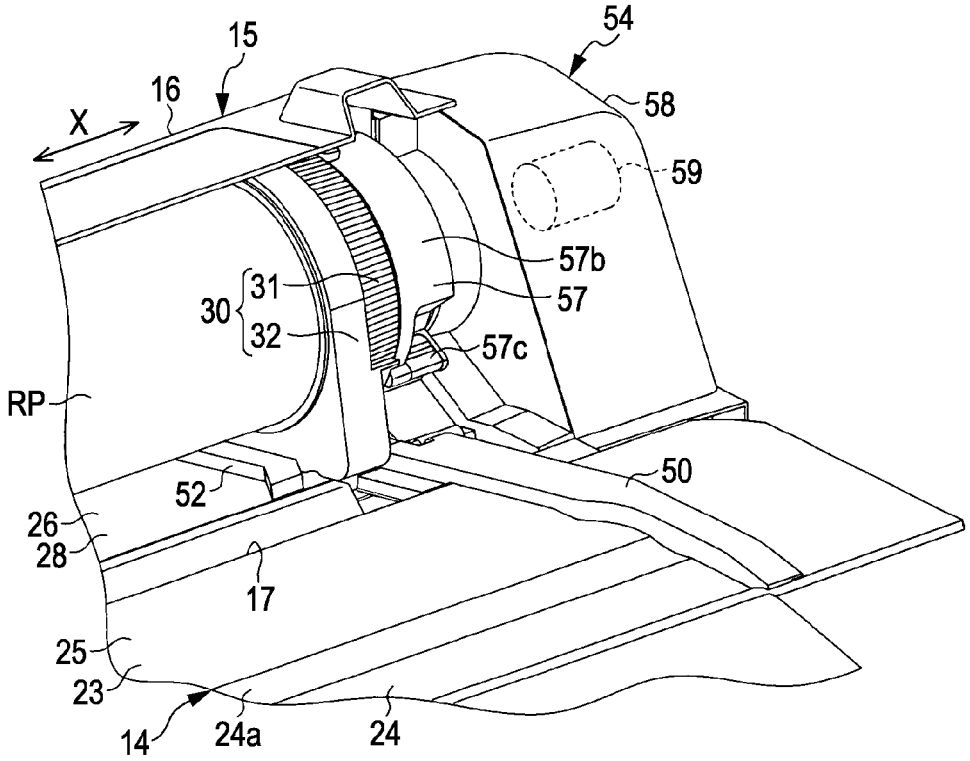
FIG. 17 is a perspective view showing a state where the operation lever is moved downward in FIG. 16.

Subsequently, as shown in FIG. 17, the operation lever 57*c* is moved to the lower side in a state where the roll paper RP mounted with the support unit 30 is placed at the placing portion 28. Thereupon, the rotation shaft 55 is moved to the transmission position, whereby being inserted in the shaft hole 38 of the shaft member 31 in the support unit 30 on the first guide member 50 side. Also, the shield portion 57*b* is moved to the shielding position, whereby shielding the access space AS.

In this case, the operation portion 57 is disposed between the shaft member 31 of the support unit 30 on the first guide member 50 side and the rotary driving portion 59 (case 58), namely at the position adjacent to the rotary driving portion 59 (case 58) side in the shaft member 31 of the support unit 30 on the first guide member 50 side. In other words, the operation portion 57 is positioned near the support unit 30 on the first guide member 50 side. Therefore, the operation of the operation portion 57 is rapidly and easily carried out by a user.

Figure 18:
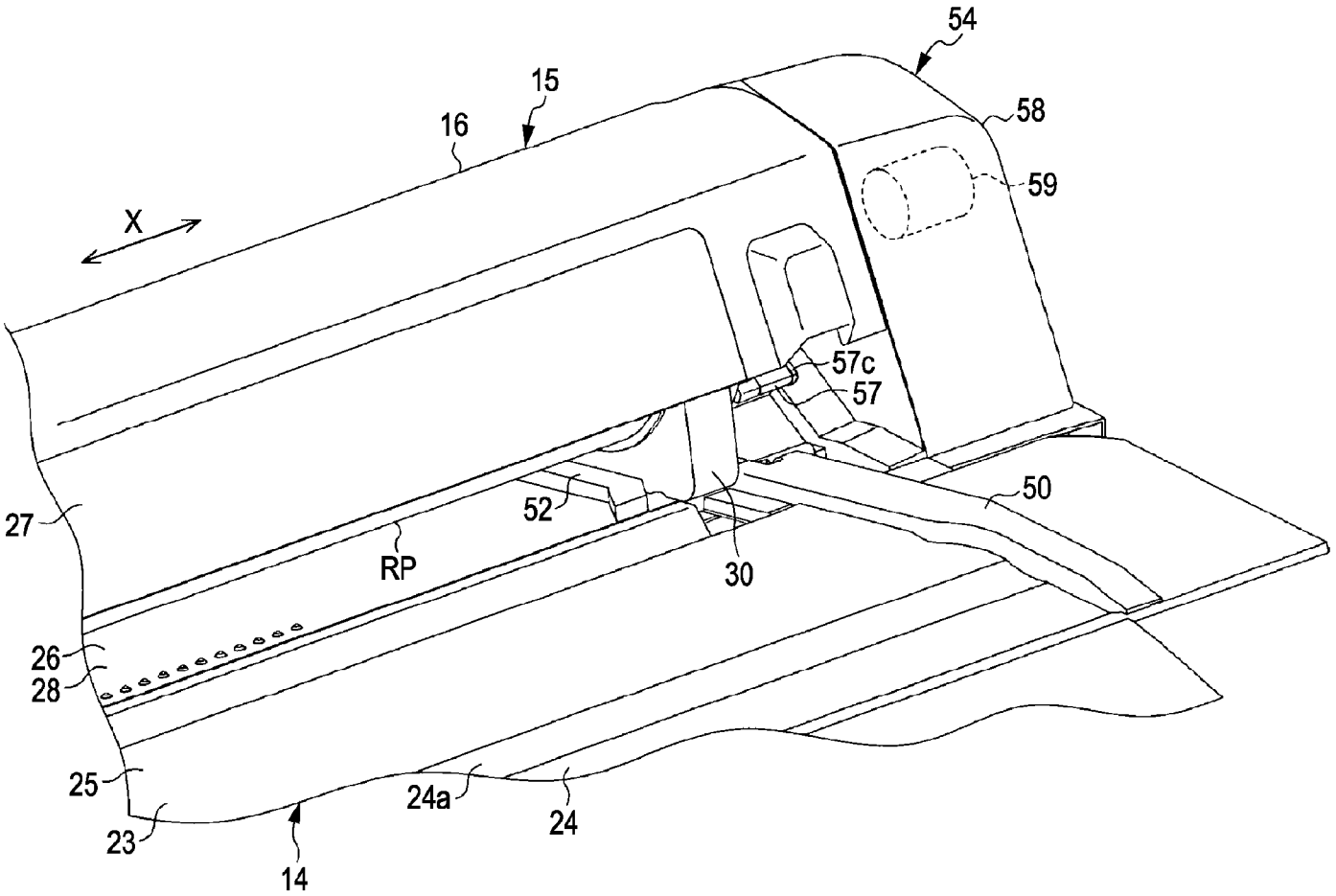
FIG. 18 is a perspective view showing a state where an opening and closing cover is closed in FIG. 17.

Next, the paper P which is unwound and fed from the roll paper RP loaded into the loading portion 15 is inserted from the paper feeding port 17 in the main body 14 along the transport path, and then the opening and closing cover 16 is closed (displaced to the covering position), as shown in FIG. 18. In this case, the operation portion 57 is accommodated in the opening and closing cover 16. Subsequently, when the operation panel 21 is operated to start the printing process, the rotation shaft 55 is rotationally driven by the driving of the motor 61, whereby the torque of the rotation shaft 55 is transmitted to the roll paper RP via the shaft member 31. Therefore, the motor 61 of the rotary driving portion 59 functions as a driving source to rotate the roll paper RP.

Thereupon, each of the shaft members 31 integrally rotates with the roll paper RP in a direction where the paper P is fed from the roll paper RP. Then, printing is performed onto the paper P fed from the roll paper RP by ejecting ink using the recording head 20 while the paper P is transported along the transport path in the main body 14. After that, the paper P is discharged from the paper discharge port 18.

According to the embodiment described in detail hereinbefore, it is possible to achieve the effects described below.

(1) In the axial direction of the roll paper RP when the roll paper RP is loaded into the loading portion 15, the operation portion 57 is disposed between the location of the shaft member 31 of the support unit 30 on the first guide member 50 side when the roll paper RP is loaded and the rotary driving portion 59 (case 58), namely at the position adjacent to the rotary driving portion 59 (case 58) side in the shaft member 31 of the support unit 30 on the first guide member 50 side. In other words, the operation portion 57 is disposed at the position near the shaft member 31 of the support unit 30 on the first guide member 50 side. Therefore, it is possible for a user to rapidly perform the operation to move the rotation shaft 55 to the transmission position. Consequently, it is possible to improve work efficiency for enabling the torque of the rotary driving portion 59 to be transmitted to the roll paper RP loaded into the loading portion 15.

(2) When the shield portion 57*b* is moved to the shielding position, the rotation shaft 55 is moved to the transmission position, and when the shield portion 57*b* is moved to the non-shielding position, the rotation shaft 55 is moved to the non-transmission position, by operating the operation lever 57*c*. Therefore, when the rotation shaft 55 transmits the torque of the rotary driving portion 59 to the roll paper RP via the shaft member 31, the access space AS is shielded by the shield portion 57*b*. Thereby, it is possible to regulate the access of a user to the shaft member 31 when rotating. On the other hand, when the rotation shaft 55 does not transmit the torque of the rotary driving portion 59 to the roll paper RP via the shaft member 31, the access space AS is not shielded by the shield portion 57*b*. Thereby, it is possible to allow the access of a user to the shaft member 31 when stopping.

(3) The operation portion 57 is configured such that, when the operation lever 57*c* is moved to the lower side, the shield portion 57*b* is moved to the shielding position, and when the operation lever 57*c* is moved to the upper side, the shield portion 57*b* is moved to the non-shielding position. Therefore, when the rotation shaft 55 transmits the torque to the roll paper RP via the shaft member 31, the shield portion 57*b* is moved to the shielding position by moving the operation lever 57*c* to the lower side. Consequently, since, when the shaft member 31 rotates, the operation lever 57*c* is positioned at the lower side, it is possible for the operation lever 57*c* not to hinder the shaft member 31.

(4) When the opening and closing cover 16 is positioned at the covering position, the operation portion 57 is accommodated in the opening and closing cover 16. Therefore, by closing (displacing to the covering position) the opening and closing cover 16 when the shaft member 31 rotates, it is possible to suppress the erroneous contact of a user to the operation portion 57 when the shaft member 31 rotates.

Modification Example

Furthermore, the embodiment described above may be modified as follows.

- When the opening and closing cover 16 is positioned at the covering position, it is not necessary for the operation portion 57 always to be accommodated in the opening and closing cover 16.
- The opening and closing cover 16 may be omitted.
- The operation portion 57 may be configured such that, when the operation lever 57*c* is moved to the lower side, the shield portion 57*b* is moved to the non-shielding position, and when the operation lever 57*c* is moved to the upper side, the shield portion 57*b* is moved to the shielding position.
- In the operation portion 57, the shield portion 57*b* may be omitted.
- Instead of the roll paper RP, plastic film, cloth, foil or the like may be used as a roll medium.
- In the embodiment described above, the recording apparatus may be a fluid ejecting apparatus which performs recording by ejecting or discharging a fluid (including a liquid, liquid body which is composed by dispersing or mixing a liquid or particles of a functional material in a liquid, a fluid body such as gel, and solid matter capable of being ejected as a fluid) aside from ink. For example, a liquid body ejecting apparatus which performs recording by ejecting a liquid body including a material such as an electrode material or a colorant material (pixel material) used for manufacturing a liquid-crystal display, an EL (electronic luminescence) display and a surface-emission display by a manner of dispersion or dissolution may be employed. Furthermore, a fluid body ejecting apparatus which ejects a fluid body such as gel (for example, physical gel) may be employed. Also, the invention can be applied to any one of the fluid ejecting apparatuses described above. In addition, "fluid" in the specification does not include a fluid composed of a gaseous body only, and includes a liquid (such as inorganic solvents, organic solvents, liquid solutions, liquid resins, and liquid metals (metallic melts)), a liquid body, a fluid body or the like, for example.

REFERENCE SIGNS LIST

11: Ink jet type printer as a recording apparatus
15: Loading portion constituting a medium loading device
16: Opening and closing cover as a cover member
20: Recording head as a recording portion
30: Support unit constituting the medium loading device
31: Shaft member as a medium holding portion
32: Flange member as a medium support portion
55: Rotation shaft as a torque transmission portion constituting the medium loading device
57: Operation portion constituting the medium loading device
57*b*: Shield portion
57*c*: Operation lever
59: Rotary driving portion constituting the medium loading device AS: Access space
P: Paper as a medium
RP: Roll paper as a roll medium

The invention claimed is:

1. A medium loading device comprising:

a support unit that has medium holding portions which are mounted on both end portions of a roll medium formed by winding a lengthy medium into a roll shape so as to be integrally rotatable with the roll medium, and a medium support portion which rotatably supports the medium holding portion; and a loading portion in which the roll medium mounted with the support unit is loaded, wherein the loading portion includes:

a rotary driving portion as a driving source to rotate the roll medium;

a torque transmission portion to transmit a torque of the rotary driving portion to the roll medium via the medium holding portion; and an operation portion that moves the torque transmission portion between a transmission position to transmit the torque to the roll medium via the medium holding portion and a non-transmission position not to transmit the torque to the roll medium via the medium holding portion, and wherein, in an axial direction of the roll medium when the roll medium is loaded into the loading portion, the operation portion is disposed between the position where the medium holding portion is located when the roll medium is loaded and the rotary driving portion.

2. The medium loading device according to claim 1, wherein, an access space to access the medium holding portion in the axial direction of the roll medium is formed between the position where the medium holding portion is located when the roll medium is loaded and the rotary driving portion, wherein the operation portion includes:

an operation lever to perform operation; and a shield portion that is moved between a shielding position to shield the access space and a non-shielding position not to shield the access space corresponding to the operation of the operation lever, and wherein, when the shield portion is moved to the shielding position, the torque transmission portion is moved to the transmission position, and when the shield portion is moved to the non-shielding position, the torque transmission portion is moved to the non-transmission position.

3. The medium loading device according to claim 2, wherein, in the operation portion, when the operation lever is moved to a lower side, the shield portion is moved to the shielding position, and when the operation lever is moved to an upper side, the shield portion is moved to the non-shielding position.

4. The medium loading device according to any one of claims 1 to 3, further comprising, a cover member that is displaceable between a covering position where the roll medium loaded into the loading portion is covered and a noncovering position where the roll medium loaded into the loading portion is not covered, wherein, when the cover member is positioned at the covering position, the operation portion is accommodated in the cover member.

5. A recording apparatus comprising:

the medium loading device according to claim 1; and a recording portion to perform a recording process onto the roll medium fed from the medium loading device.

6. A medium loading device comprising:

a loading portion for loading a roll medium; and a medium holding portion which is mounted to the roll medium so as to be integrally rotatable with the roll medium, wherein the loading portion includes:

a rotary driving portion as a driving source to rotate the roll medium;

a torque transmission portion to transmit a torque of the rotary driving portion to the roll medium via the medium holding portion; and an operation portion that moves the torque transmission portion, wherein, when the roll medium is loaded, the operation portion is disposed between the rotary driving portion and the medium holding portion.

7. The medium loading device according to claim 6, wherein, an access space to access the medium holding portion in the axial direction of the roll medium is formed between the position where the medium holding portion is located when the roll medium is loaded and the rotary driving portion.

8. The medium loading device according to claim 7, wherein the operation portion includes: an operation lever to perform operation; and a shield portion that is moved between a shielding position to shield the access space and a non-shielding position not to shield the access space corresponding to the operation of the operation lever.

9. The medium loading device according to claim 8, wherein, when the shield portion is moved to the shielding position, the torque transmission portion is moved to the transmission position, and when the shield portion is moved to the non-shielding position, the torque transmission portion is moved to the non-transmission position.

10. The medium loading device according to claim 8, wherein, in the operation portion, when the operation lever is moved to a lower side, the shield portion is moved to the shielding position, and when the operation lever is moved to an upper side, the shield portion is moved to the non-shielding position.

11. The medium loading device according to any one of claims 6 to 10, further comprising, a cover member that is displaceable between a covering position where the roll medium loaded into the loading portion is covered and a noncovering position where the roll medium loaded into the loading portion is not covered, wherein, when the cover member is positioned at the covering position, the operation portion is accommodated in the cover member.

12. A recording apparatus comprising: the medium loading device according to claim 6; and a recording portion to perform a recording process onto the roll medium fed from the medium loading device.

* * * * *